United States Patent [19]

Miyamoto et al.

[11] 4,330,734

[45] May 18, 1982

[54] IMAGE PICKUP TUBE WITH MESH ELECTRODE SUPPORT

[75] Inventors: Satoru Miyamoto, Mobara; Takeo Yoshida, Misaki, both of Japan

[73] Assignee: Hitachi, Ltd., Tokyo, Japan

[21] Appl. No.: 118,524

[22] Filed: Feb. 4, 1980

[30] Foreign Application Priority Data

Feb. 13, 1979 [JP] Japan ..... 54-14224

[51] Int. Cl.[3] ..... H01J 29/02; H01J 29/82; H01J 31/38

[52] U.S. Cl. ..... 313/390; 313/268; 313/313

[58] Field of Search ..... 313/390, 378, 268, 313, 313/383

[56] References Cited

U.S. PATENT DOCUMENTS

| | | | |
|---|---|---|---|
| 3,073,981 | 1/1963 | Miller et al. | 313/390 |
| 3,303,373 | 2/1967 | Alting-Mees | 313/378 |
| 3,321,655 | 5/1967 | Saldi | 313/390 |
| 3,325,672 | 6/1967 | Funahashi et al. | 313/390 X |
| 3,523,205 | 8/1970 | Oess | 313/313 X |

*Primary Examiner*—Palmer C. Demeo
*Attorney, Agent, or Firm*—Charles E. Pfund

[57] ABSTRACT

The structure of an electrode for collimation lens in an image pickup tube has an improved joint for an accelerating electrode of an electron gun and a mesh electrode. The joint has an electrode support member integral with the fore end of the accelerating electrode and having a cylindrical center portion width not overlapped with the fore end, and a glass bead for connecting the width and the mesh electrode.

6 Claims, 5 Drawing Figures

IMAGE PICKUP TUBE WITH MESH ELECTRODE SUPPORT

BACKGROUND OF THE INVENTION

The present invention relates to an image pickup tube, and more particularly to an improvement in the structure of an electrode for collimation lens arranged near a photoconductive target of the image pickup tube.

In conventional image pickup tubes for general use of so-called separate mesh electrode type, a mesh electrode in the most close proximity of a target electrode and a cylindrical accelerating electrode adjacent to the mesh electrode are electrically isolated and applied with different potentials to form a collimation lens. In order to maintain coaxial disposition of the accelerating electrode and the mesh electrode within a bulb of the image pickup tube, in a conventional image pickup tube as disclosed in U.S. Pat. No. 3,073,981 to Louis D. Miller et al. (especially FIG. 2), for example, an insulator is arranged circumferentially of a fore end of the cylindrical accelerating electrode, which end is close to the mesh electrode, and the accelerating electrode and the mesh electrode are jointed together through the insulator. In such a joint, a first support ring is used for mounting the insulator to the accelerating electrode and a second support ring for mounting the insulator to a mesh support electrode extending from the mesh electrode. The first support ring secured to one portion of the insulator is usually fixed to the accelerating electrode by spot welding. Similarly, the second support ring secured to the opposite portion of the insulator is fixed to the mesh support electrode by spot welding.

However, the joint of the accelerating electrode and the mesh electrode in the image pickup tube constructed in the above mentioned manner includes an extremely large number of parts, most of which are joined by spot welding, thus radically complicating the manufacturing process. This not only increases the number of work steps excessively, but also gives rise to a great quantity of wastes and dirt caused in these work steps, particularly by splashes during spot welding. This was naturally undersirable for various properties of an image pickup tube. In the structure as above mentioned, the accuracy of centering for the accelerating electrode and the mesh electrode is subject to dimensional accuracies of the accelerating electrode, the insulator and the support member as they are stacked over each other and therefore, the accuracy of the axial relation between the accelerating electrode and the mesh electrode becomes irregular and at the extremity degraded, so that the image pickup tube properties are deteriorated and particularly the picture distortion properties are aggravated. Further, since the first support ring and the accelerating electrode are fixed together by spot welding as mentioned above, such that the support ring and the accelerating electrode are perfectly jointed to each other at the point where the welding has been performed, they are not jointed at other points, at which gaps equal to the dimensional difference between the outer diameter of the accelerating electrode and the inner diameter of the support ring are created. This results in a polygonal cylindrical shape of the accelerating electrode and disturbance in the electric field in the proximity thereof, thus degrading the image pickup tube properties.

SUMMARY OF THE INVENTION

An object of this invention is to provide an image pickup tube wherein the joint between the accelerating electrode and the mesh electrode can be obtained with high accuracies and at low cost.

According to this invention, in an image pickup tube comprising a cylindrical glass envelope housing an electron gun having a plurality of cylindrical electrodes, a mesh electrode provided co-axially with and in front of the electron gun, a photoconductive target electrode provided at one end of the glass envelope, and an electrode support member provided on the outer periphery of the cylindrical electrodes to achieve alignment of the center axes of the glass envelope and the electron gun, the electrode support member is fixed to a fore end of a cylindrical electrode placed most proximate to the mesh electrode, and a substantial width of a cylindrical center portion of the electrode support member and the mesh electrode are jointed by an insulating bar shaped fixing piece, the width being not overlapped with the fore end.

DESCRIPTION OF PREFERRED EMBODIMENTS

Prior to give a description of a preferred embodiment of the invention, for better understanding of the present invention, the conventional image pickup tube as exemplified in the foregoing will first be described in more detail by referring to FIGS. 1 and 2.

Figure 1:
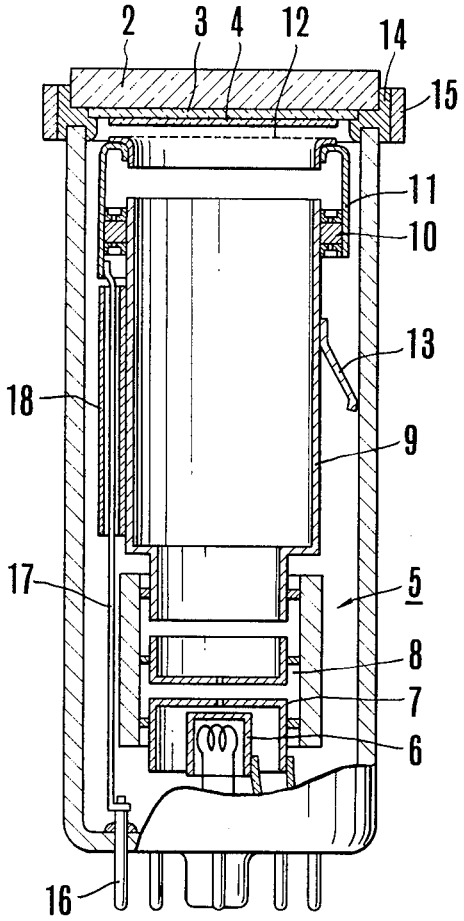
FIG. 1 PRIOR ART

FIG. 1 shows an example of a conventionai type image pickup tube wherein reference numeral 1 denotes a cylindrical bulb made of glass. There are formed a face plate 2 at one (fore) end of the bulb 1 and a signal electrode 3 formed on the inner surface of the face plate 2. Reference numeral 4 denotes a target electrode formed on the signal electrode. At the other end of the bulb 1 is provided an electron gun 5, and reference numerals 6, 7 and 8 denote respectively a cathode electrode, a first grid electrode and a second grid electrode of the electron gun 5. There is provided a cylindrical accelerating electrode 9 extending toward the target electrode 4 from the electron gun 5. The one (fore) end of the accelerating electrode close to the target electrode is connected to a mesh support electrode 11 via an insulating member 10. At one end of the support electrode 11 is fixedly provided a mesh electrode 12 at a predetermined distance from the target electrode 4. The reference numeral 13 denotes resilient support members fixed at one end thereof to the accelerating electrode 9 and opened, at the other end, toward the electron gun 5 to provide a spring action. Because of the spring action, the resilient support member abuts against the inner wall of the bulb 1 and securedly supports the accelerating electrode 9 and the mesh support electrode 11 coaxially in respect of the bulb 1. There are provided at least three such resilient support members 13. Reference numeral 14 denotes a conductive material, and 15 a target ring.

A lead-in wire 16 is connected to the mesh support electrode 11 via a feeder 17, which feeder is so constructed as to be inserted in an insulating cylinder 18 without contacting the accelerating electrode 9.

Figure 2:
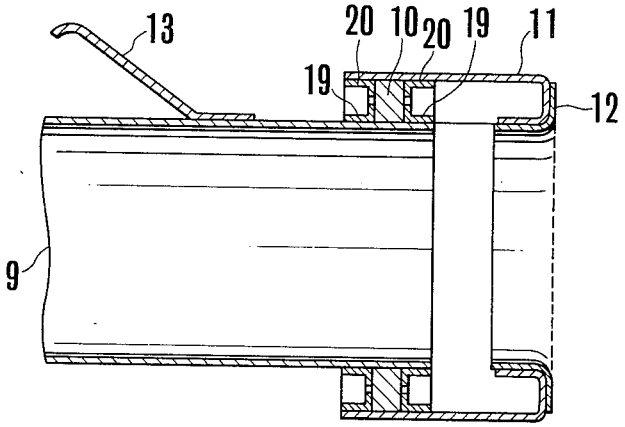
FIG.2 PRIOR ART

The joint of the accelerating electrode 9 and the mesh electrode 12 in the above conventional image pickup tube is accomplished as detailed in FIG. 2. As shown the insulating member 10 arranged between the accelerating electrode 9 and the mesh support electrode 11 is fixed by a first support ring 19 to the accelerating electrode 9 in such a way as to maintain electrical insulation between the accelerating electrode 9 and the mesh electrode 12, whereas it is supported and fixed to the mesh support electrode 11 by a second support ring 20. Such a joint suffers from a number of disadvantages as explained in the foregoing description.

Figure 3:
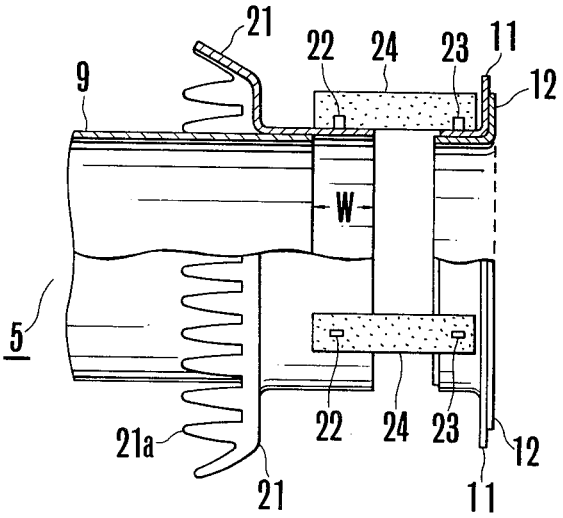

Referring now to FIG. 3, there is shown substantial part of an image pickup tube embodying the present invention. The remaining parts of the image pickup tube are the same as those of FIGS. 1 and 2. In the figure, reference numeral 21 denotes a resilient support member prepared by press forming non-magnetic stainless steel, the resilient support member 21 having a plurality of radial blades 21*a* in order to maintain the center axis of the electron gun 5 and the center axis of the bulb 1 (not shown) in alignment with each other, and its cylindrical center portion being fixed to the fore end of the accelerating electrode 9 by means of spot welding, with a width W of the resilient support member not overlapped with the fore end of the accelerating electrode 9. The cylindrical portion of resilient support member 21 can be made seamless and can have a high degree of roundness. Accordingly, if the cylindrical accelerating electrode has a longitudinal seam for saving cost, the seamless width W of the resilient support member, which is integral with the accelerating electrode, can act as a fore end of the accelerating electrode so that electric field can be uniform. On the other hand, the resilient support member 21 must have a suitable elasticity, and when it is made of stainless steel, the thickness thereof is preferred to be 0.08–0.1 mm. Reference numeral 22 denotes a pin integral with the width W of the resilient support member 21 and provided at an equal spacing of 120° on the outer circumferential surface of the resilient support member 21, 23 a pin integral with the mesh support electrode 11 and provided at an equal spacing of 120° on the outer circumferential surface of the mesh support electrode 11, and 24 an insulating material such as bar-shaped glass bead. The glass bead 24 is fixed by fusing to the pin 22 of the resilient support member 21 and the pin 23 of the mesh support electrode 11 to cause the three bars of glass bead 24 to hold and fix the mesh support electrode 11 to the resilient support member 21.

In assembling the electron gun structure as described above, the resilient support member 21 and the mesh support electrode 11 are inserted into a suitable jig not shown. The peripheral portion is then heated until the glass bead 24 is pressed against the pins 22, 23 and when the glass bead 24 becomes cooled and hardened, they are taken out of the jig. The one (fore) end of the accelerating electrode 9 is then inserted into the resilient support member 21 and fixed thereto by means of spot welding to complete the joint for the mesh electrode. In the above mentioned beading operation, the thickness of the resilient support member 21 and the mesh support electrode 11 is preferred to be as thick as possible for less deformation and improved precision. In this instance, it is possible to use the jig with a considerably severe dimensional tolerance, and if the precision for the jig is determined correspondingly to the precision required for the electrode, then there will be no difficulties whatsoever. Moreover, the beading operation can be carried out after heating the glass and softening bead 24 to a degree at which the glass bead will not thermally deformed. Thus, it was confirmed through experiments that the thickness for the mesh support electrode 11 was sufficient if it was 0.08–0.1 mm. According to the electron gun constructed as above, the support rings 19, 20 which were required in the conventional gun to fix the mesh support electrode 11 to the accelerating electrode 9 become no longer necessary, and the spot welding operation for welding the support rings 19, 20 to the accelerating electrode 9 and the mesh support electrode 11 is not needed either, thus completely getting rid of polygonal deformations of the fore end of the accelerating electrode 9 caused by spot welding and radically decreasing the number of work steps. The number of glass beads 24 to support and fix the mesh electrode 12 and the mesh support electrode 11 is preferred to be at least three in view of the reliability, and as these three are simultaneously fixed, the deformations which might occur to the accelerating electrode by the jig or the devices used in the beading operation will have uniform direction. This means that any distortion in the registration of a so-called tri-tube type color television camera where three image pickup tubes are used will also become uniform, thus presenting neither problems nor difficulties. In the construction as above, the end of the accelerating electrode 9 is provided with the single resilient support member 21, and the mesh electrode 12 and the mesh support electrode 11 are supported fixedly by the glass bead 24, thereby diminishing the required number of components, and decreasing the possibility of dust generation through contacts of various components, as well as radically reducing the number of work steps in the assembly line. For applying the present invention to an image pickup tube of the non-separate type electrode where the potentials for the accelerating electrode 9 and the mesh electrode 12 are equal, the accelerating electrode 9 and the mesh electrode 12 are connected by an electrically conductive conductor in place of the glass bead. Alternatively, an electrical conductor and the glass bead in combination may be applied across the accelerating and mesh electrodes.

Figure 4:
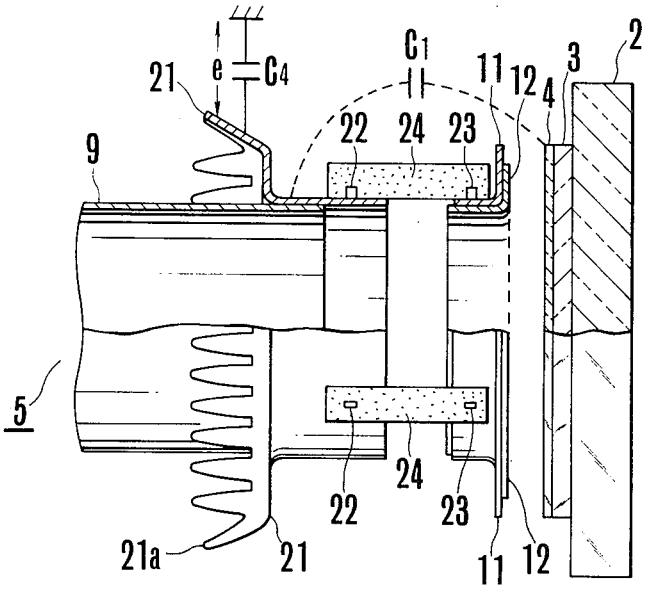
Figure 5:
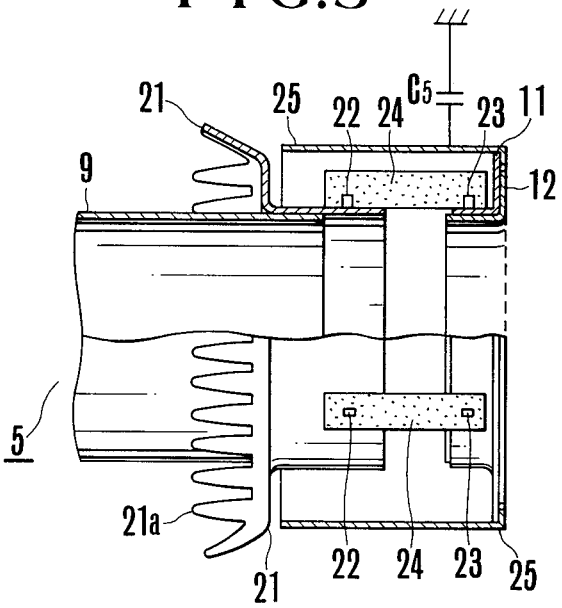

Since the image pickup tube in accordance with the present invention described above has a deflecting coil wound about the outer circumferential surface of the bulb 1 not shown, there is induced deflection pulse voltage e at the end of the accelerating electrode 9 and the resilient support member 21 by magnetic field created by this deflecting coil as shown in FIG. 4. Because of a stray capacitor C1 between the resilient support member 21 and the target electrode 4, the pulse voltage e comes into the target electrode 4 and disturbs the normal signal current to be taken out from the target electrode 4. In other words, the pulse voltage e is superimposed on the signal current. In typical image pickup tubes, the accelerating electrode 9 is grounded via a capacitor C4 so that the pulse voltage e flows through the capacitor C4 to the earth and hardly affects the target electrode 4. However, in some types in which the capacitor C4 is not incorporated, such as for example a dynamic focus type image pickup tube (wherein a suitable high frequency voltage is applied on the accelerating electrode 9 in synchronism with the scanning of the electron beam to correct the beam landing), the above mentioned voltage e interferes with the target electrode 4. This is prevented by providing a cylindrical electrostatic shield member 25 made of non-magnetic material such as copper or molybdenum at the periphery of the mesh support electrode 11 as shown in FIG. 5 in such a way as to surround the glass bead 24. In any types, the mesh support electrode 11 is grounded by a capacitor C5, thereby preventing the pulse voltage e from coming into the target electrode 4.

As explained hereinabove, the image pickup tube according to the present invention radically improves the assembling accuracies of the joint between the accelerating electrode and the mesh electrode to thereby improve the properties of the image pickup tube. Moreover, since the components for such a tube may be mass-produced by press forming operation, the mass producibility of the device is remarkably improved, the cost therefor is curtailed radically, and the quality and reliability are extremely ameliorated.

What is claimed is:

1. In an image pickup tube comprising a cylindrical glass envelope housing an electron gun having a plurality of cylindrical electrodes, a mesh electrode provided co-axially with and in front of said electron gun, a photoconductive target electrode provided at one end of said glass envelope, and an electrode support member provided on the outer periphery of said cylindrical electrodes to achieve alignment of the center axes of said glass envelope and said electron gun, the improvement wherein said electrode support member is fixed to a fore end of said cylindrical electrode most proximate to said mesh electrode, and a substantial width of a cylindrical portion of said electrode support member extends beyond said cylindrical electrode toward said mesh electrode, said substantial width being not overlapped with said fore end, performed projections on said electrode support member and said mesh electrode, and insulating bar-shaped pieces supporting said mesh electrode coaxially and at a fixed gap distance from said fore end by engagement with said projections while the elements of the assembly are held in accurate alignment.

2. An image pickup tube as claimed in claim 1 wherein said insulating bar shaped pieces comprise glass beads which have said projections embedded in the glass beads when they are in a softened condition.

3. An image pickup tube as claimed in claim 1 wherein pins are provided fixed to said width and mesh electrode, for connection to said insulating bar shaped pieces.

4. An impage pickup tube as claimed in claim 1 which further comprises an electrostatic shield member made of non-magnetic material which is provided on said mesh electrode.

5. An image pickup tube as claimed in claim 4 wherein said insulating bar shaped fixing piece comprises a glass bead.

6. An image pickup tube as claimed in claim 4 wherein pins are provided fixed to said width and mesh electrode, for connection to said insulating bar shaped pieces.

* * * * *